US012692764B2

(12) United States Patent
D'Souza

(10) Patent No.: US 12,692,764 B2
(45) Date of Patent: Jul. 28, 2026

(54) VALVE SYSTEM FOR USE IN A WELLBORE

(71) Applicant: INTERWELL NORWAY AS, Røyneberg (NO)

(72) Inventor: Rylan Paul D'Souza, Abu Dhabi (AE)

(73) Assignee: Interwell Norway AS, Røyneberg (NO)

( * ) Notice: Subject to any disclaimer, the term of this patent is extended or adjusted under 35 U.S.C. 154(b) by 2 days.

(21) Appl. No.: 19/103,993

(22) PCT Filed: Aug. 22, 2023

(86) PCT No.: PCT/NO2023/060034
§ 371 (c)(1),
(2) Date: Feb. 14, 2025

(87) PCT Pub. No.: WO2024/043786
PCT Pub. Date: Feb. 29, 2024

(65) Prior Publication Data

US 2026/0049535 A1 Feb. 19, 2026

(30) Foreign Application Priority Data

Aug. 23, 2022 (NO) ..... 20220902

(51) Int. Cl.
*E21B 34/06* (2006.01)
*E21B 43/12* (2006.01)

(52) U.S. Cl.
CPC ..... *E21B 34/066* (2013.01); *E21B 43/123* (2013.01); *E21B 2200/02* (2020.05)

(58) Field of Classification Search
CPC ... E21B 34/066; E21B 43/123; E21B 2200/02
See application file for complete search history.

(56) References Cited

U.S. PATENT DOCUMENTS 5,533,572 A 7/1996 Brady et al.
6,148,843 A * 11/2000 Pringle ..... E21B 43/123 137/155

(Continued)

FOREIGN PATENT DOCUMENTS

| | | | |
|---|---|---|---|
| EP | 1686235 | A1 | 8/2006 |
| WO | 0106130 | A1 | 1/2001 |
| WO | 2016181154 | A1 | 11/2016 |

OTHER PUBLICATIONS

International Search Report for corresponding PCT Application No. PCT/NO2023/060034, mailed Nov. 25, 2023. (4 pages.).

(Continued)

*Primary Examiner* — P. Macade Nichols
(74) *Attorney, Agent, or Firm* — K&L Gates LLP

(57) ABSTRACT

A valve system for use in a wellbore, the valve system comprising a side pocket mandrel having a main bore for alignment with a tubular in the wellbore, a laterally offset side pocket bore which is enclosed by a side pocket wall, and first and second ports which each extend through the side pocket wall into the side pocket bore, the valve system further comprising first valve assembly which is operable to control flow of fluid from the exterior of the side pocket bore to the first port, and a second valve assembly which is located in the side pocket bore to close the second port and which is operable to control flow of fluid from the first port to the main bore of the side pocket mandrel.

16 Claims, 4 Drawing Sheets

(56) References Cited

U.S. PATENT DOCUMENTS

| | | | |
|---|---|---|---|
| 2003/0164240 | A1 | 9/2003 | Vinegar et al. |
| 2006/0137881 | A1 | 6/2006 | Schmidt et al. |
| 2007/0235197 | A1 | 10/2007 | Becker et al. |
| 2013/0220599 | A1 | 8/2013 | Rae |
| 2018/0149002 | A1 | 5/2018 | Murdoch et al. |
| 2021/0095547 | A1 | 4/2021 | Grueschow et al. |
| 2021/0140288 | A1 | 5/2021 | Lisk et al. |
| 2022/0220834 | A1 | 7/2022 | Brown et al. |

OTHER PUBLICATIONS

Written Opinion for corresponding PCT Application No. PCT/NO2023/060034, mailed Nov. 25, 2023. (6 pages.).
Search Report for the corresponding Norwegian priority application No. 20220902, dated Nov. 29, 2022. (2 pages.).

* cited by examiner

VALVE SYSTEM FOR USE IN A WELLBORE

CROSS REFERENCE TO RELATED APPLICATIONS

The present application is a National Stage of International Application No. PCT/NO2023/060034 filed Aug. 22, 2023, which claims priority to Norwegian Patent Application No. 20220902 filed Aug. 23, 2022, the entire contents of which are incorporated herein by reference.

The present invention relates to a valve system, and particularly a valve system for use in hydrocarbon production from a wellbore.

BACKGROUND

In hydrocarbon production, when a wellbore is drilled into a hydrocarbon bearing earth formation, the fluid pressure in the formation may be sufficient to cause hydrocarbons from the formation to flow up the wellbore to the surface. In some wells, however, the formation pressure is insufficient to do this, and hydrocarbon production from the well requires the use of an artificial lift system to supplement the formation pressure to lift the hydrocarbons from the formation to the surface.

One such artificial lifting system is a "gas lift system" in which a high pressure gas is injected into a production tubing which extends down the wellbore to the formation. The high pressure gas may be supplied through the annulus between the production tubing and the wellbore casing, and injected into the production tubing via one or more gas lift valves which are arranged on the production tubing at the required depth in the wellbore. The gas lift valve(s) may be arranged in the production tubing itself, or they may be arranged in side pockets mandrels.

Publications which may be useful to understand the background include WO2019/004838 and WO2019/074374.

The present application relates to a new configuration of valve system suitable for use in a gas lift system.

SUMMARY

According to a first aspect, we provide a valve system for use in a wellbore, the valve system comprising a side pocket mandrel having a main bore for alignment with a tubular in the wellbore, a laterally offset side pocket bore which is enclosed by a side pocket wall, and first and second ports which each extend through the side pocket wall into the side pocket bore, the valve system further comprising a first valve assembly which is operable to control flow of fluid from the exterior of the side pocket bore into the side pocket bore via the first port, and a second valve assembly which is located in the side pocket bore to close the second port and which is operable to control flow of fluid from the side pocket bore to the main bore of the side pocket mandrel.

Advantageously, the first valve assembly is located outside/at the exterior of the side pocket bore.

The first port may extend through the side pocket wall from an exterior surface of the side pocket mandrel. Furthermore, the first valve assembly may be mounted on the exterior surface of the side pocket mandrel.

Alternatively, the first port may extend from the main bore to the side pocket bore. In this case, the side pocket mandrel may be provided with a third port which extends through the side pocket mandrel from an exterior surface thereof to the main bore. In this case, the first valve assembly may be mounted in the main bore of the side pocket mandrel and configured to control flow of fluid from the exterior of the side pocket mandrel through the third port and to the first port.

The first valve assembly may comprise a remotely controllable choke assembly which is operable to control the rate of flow of fluid from the exterior of the side pocket mandrel to the first port.

The choke assembly may comprise a choke and an electrically or hydraulically operated choke actuator.

The first valve assembly may comprise an electronic controller which is connected to and configured to control the operation of the choke assembly. The electronic controller may have a signal interface and be configured to transmit data signals via the signal interface. The electronic controller may also be configured to receive control and/or data signals via the signal interface.

The first valve assembly may comprise a generator which is configured to convert kinetic energy derived from flow of fluid from the exterior of the side pocket mandrel to the first port and/or temperature differential energy between the exterior of the side pocket mandrel and the main bore into electrical energy.

The first valve assembly may comprise a sensor system which is configured to measure one or more of the following: the pressure at the exterior of the side pocket mandrel, the temperature at the exterior of the side pocket mandrel, the pressure in the main bore of the side pocket mandrel, or the temperature in the main bore of the side pocket mandrel. The first valve assembly may comprise a choke actuator motor and a power supply storage (battery).

The valve system may further comprise a sub which encloses a main bore and which is secured to one end of the side pocket mandrel so that the main bore or the sub aligns with the main bore of the side pocket mandrel, the first valve assembly being mounted on or in the sub.

Alternatively, the valve system may further be enclosed in a sub that can be set in the tubing and interface and communicate with the data transmission cable via an inductive coupler or wet mate connector.

The second valve assembly may comprise a check valve which moves from a closed position in which it prevents flow of fluid between the main bore and the first port (when the main bore pressure exceeds the pressure at the first port) of the side pocket mandrel, to an open position, in which it permits flow of fluid from the first port into the main bore of the side pocket mandrel, when the pressure at the first port exceeds the pressure in the main bore by a pre-determined amount.

The second valve assembly may be removable from the side pocket bore, for example, by wireline without having to pull the tubing.

The side pocket mandrel may further comprise a check valve which is moveable between a closed position in which it blocks flow of fluid between the side pocket bore and the first port and an open position in which it allows flow of fluid between the first port and the side pocket bore, and being configured be retained in the open position by the second valve assembly, when the second valve assembly is in the side pocket bore, and to move to the closed position when the second valve assembly is removed from the side pocket bore.

The second valve assembly is configured so that the release and removal of the second valve assembly can be carried out using a wireline retrieval operation, with the second valve assembly being pulled up through the production tubing. As such, if, during the gas lift process, there is an electrical fault in the first valve assembly, the choke fails closed (i.e. block the flow of gas into the first port), and stops flow of gas into the side pocket mandrel, the second valve assembly can be retrieved via a wireline. The removal of the second valve assembly causes the check valve in the first port to close to prevent flow of fluid through the first port. A conventional pressure operated gas lift valve may then be run down the production tubing on a wireline and landed in the same side pocket bore, to control flow of gas into the main bore via the second port. The valve system is therefore configured such that the gas lift process can be resumed without pulling the production tubing, albeit without the precise electronic control of the gas delivery provided by the first valve assembly.

BRIEF DESCRIPTION OF THE DRAWINGS

These and other characteristics will become clear from the following description of illustrative embodiments, given as non-restrictive examples, with reference to the attached drawings, in which.

DETAILED DESCRIPTION

Figure 1:
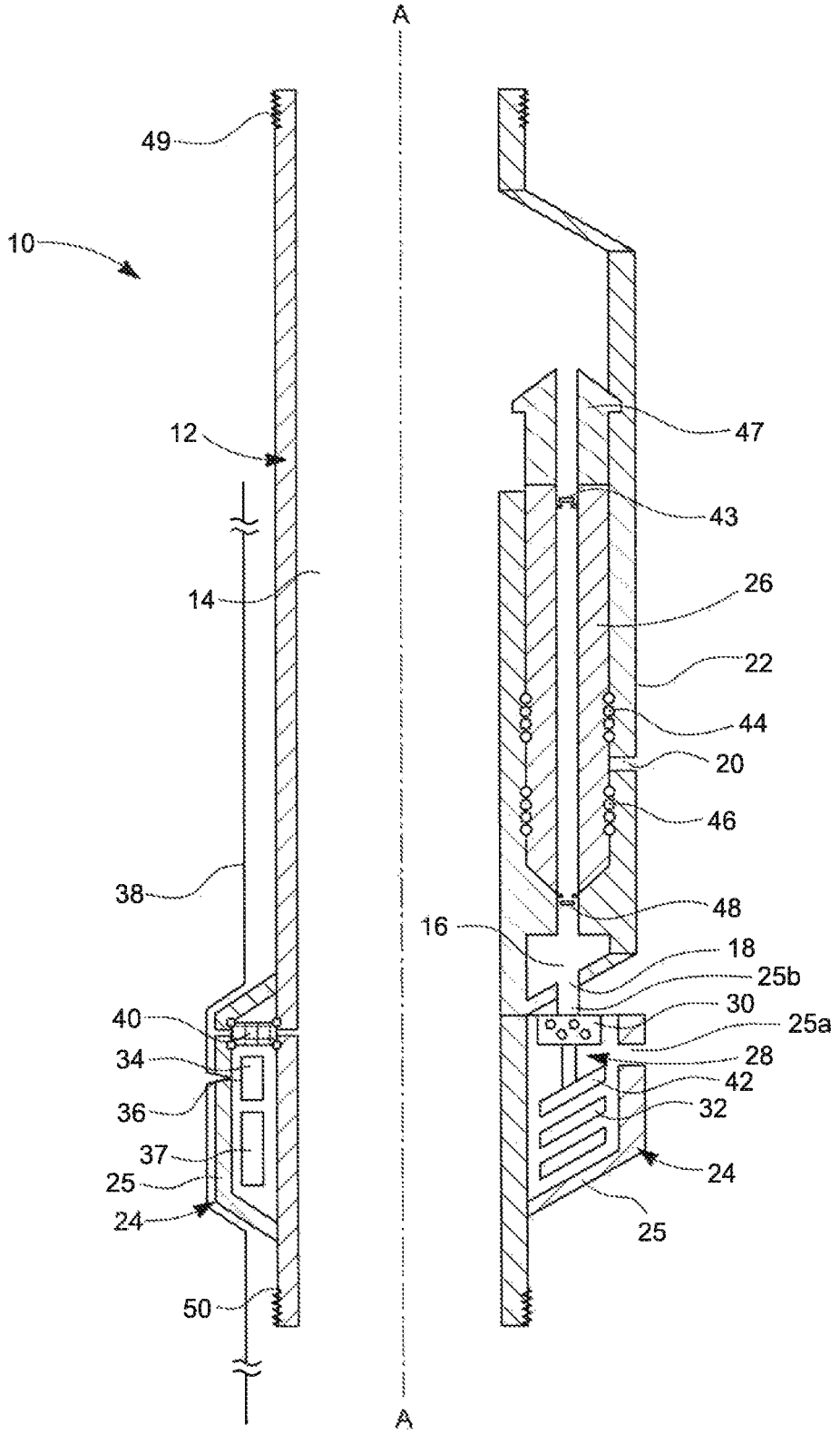
FIG. 1 is a schematic view of a longitudinal cross-section through a valve system according to the disclosed technology with the second valve assembly in place in the side pocket bore and flow of fluid into the main bore being controlled by the first valve assembly.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 shows a valve system 10 for use in a wellbore, the valve system 10 comprising a side pocket mandrel 12 having a main bore 14 which extends along a longitudinal axis A of the side pocket mandrel 12, and a laterally offset side pocket bore 16 which is enclosed by a side pocket wall. The side pocket mandrel 12 further comprises first and second ports 18, 20 which each extend through the side pocket wall into the side pocket bore 16.

In this embodiment, the second port 20 is provided in a portion of the exterior surface 22 of the side pocket wall which is generally parallel to the longitudinal axis A, and extends generally perpendicular to the longitudinal axis A to a generally central (longitudinally) portion of the side pocket bore 16, whilst the first port 18 extends from a portion of the exterior surface 22 which is inclined relative to the longitudinal axis A into an end portion of the side pocket bore 16.

The valve system 10 further comprises a first valve assembly 24 which is operable to control flow of fluid from the exterior of the side pocket mandrel 12 to the first port 18, and a second valve assembly 26 which is located in the side pocket bore 16 to close the second port 20 and which is operable to control flow of fluid from the first port 18 to the main bore 14 of the side pocket mandrel 12.

The first valve assembly 24 is provided in a housing 25 which, in this embodiment, is secured to the exterior surface 22 of the side pocket mandrel 12 adjacent to the first port 18. The housing 25 has an inlet port 25*a* which provides a conduit for flow of fluid from the exterior of the side pocket mandrel 12 into the interior of the housing 25, and an outlet port 25*b* which connects the interior of the housing 25 to the first port 18.

The first valve assembly 24 comprise an electrically operable choke assembly 28 which is operable to control the rate of flow of fluid from the exterior of the side pocket mandrel 12 to the first port 18. The choke assembly 28 comprises a choke 30 and an electrically operated choke actuator 32 which is operable to move the choke 30. In this embodiment, the choke actuator 32 comprises an electric motor and a gearing assembly. The position of the choke 30 determines the extent to which the flow path from the inlet 25*a* to the outlet 25*b* is restricted, and so the choke actuator 32 may be controlled to move the choke 30 to change its position.

If there is an electrical fault in the first valve assembly 24, the choke 30 is configured to fail closed (i.e. to block the flow of gas into the first port 18).

The first valve assembly 24 also comprises an electronic controller 34 which is connected to and configured to control the operation of the choke actuator 32. The choke assembly 36 may further comprise a position sensor which is connected to the electronic controller 34 and which is configured to transmit to the electronic controller an electrical signal representing the position of the choke.

In this embodiment, the electronic controller 34 has a signal interface 36 and is configured to transmit data signals via the signal interface 36 and to receive control and/or data signals via the signal interface 36.

The first valve assembly 24 also comprises a power supply 37 such as a battery, which is connected to and provide electrical power to the electronic controller 34 and choke actuator 32. The power supply 37 in this embodiment further comprises a capacitor which is connected to the battery to be charged by the battery and to the electronic controller 34 to supply electrical power to the electronic controller 34.

In this embodiment, the valve system 10 is provided with a data transmission cable 38 which is connected to the signal interface 36 of the electronic controller 34 via a wet mate connector or splice. The signal interface 36 could, however, be connected to the data transmission cable 38 via an inductive coupling. Equally, the signal interface 36 could comprise a wireless transmitter/receiver, so that data or control signals can be transmitted to or received from a remote location wirelessly.

The first valve assembly 24 also comprises a sensor system 40 which is configured to measure one or more of the following: the pressure at the exterior of the side pocket mandrel, the temperature at the exterior of the side pocket mandrel, the pressure in the main bore of the side pocket mandrel, or the temperature in the main bore of the side pocket mandrel. In this embodiment, the sensor system 40 comprises two pairs of pressure and temperature sensors. The sensors in one pair are in fluid communication with the exterior of the side pocket mandrel 12, and so generate signals representing the pressure and temperature at the exterior of the side pocket mandrel 12. The sensors in the other pair are in fluid communication with the main bore 14, and so generate signals representing the pressure and temperature in the main bore 14.

The sensor system 40 is connected to the electronic controller 34 and the electronic controller 34 is programmed to process these signals and to control the choke actuator 32 based on the signal received from one or more of the sensors in the sensor system 40. The electronic controller 34 may also transmit the signals from the sensor system 40 to the data transmission cable 38 via the signal interface 36.

In this embodiment, the first valve assembly 24 also comprises a generator 42 which is configured to generate electricity from fluid flowing from the exterior of the side pocket mandrel 12 to the first port 18. The generator 42 may be configured to convert the kinetic energy energy of fluid flowing from the inlet 25*a* to the outlet 25*b* into electrical energy. In this case, the generator 42 may also be connected to the electronic controller 34 and be configured to act as a flow meter by generating and transmitting to the electronic controller 34 an electrical signal representing the speed of this fluid flow. Alternatively, or additionally, the generator 42 may be configured to convert thermal differential energy of the fluid flowing from the inlet 25*a* to the tubing fluid to electrical energy. The generator 42 is connected to the battery 27 so that the electrical power generated may be stored in the battery 27.

The second valve assembly 26 comprises a check valve 43 which moves from a closed position in which it prevents flow of fluid between the main bore 14 and the first port 18 of the side pocket mandrel 12, when the main bore 14 pressure exceeds the pressure at the first port 18, to an open position, in which it permits flow of fluid from the first port 18 into the main bore 14 of the side pocket mandrel 12, when the pressure at the first port 18 exceeds the pressure in the main bore 14 by a pre-determined amount. It completely fills a substantial portion of the side pocket bore 16 and has around its circumference a first set of seals 44 and second set of seals 46 which engage with the walls of the side pocket mandrel 12 which enclose the side pocket bore 16 to provide a substantially fluid tight seal between the side pocket mandrel 12 and the second valve assembly 26. The second valve assembly 26 is positioned in the side pocket bore 16 such that the second port 20 connects with the side pocket bore 16 between first set of seals 44 and second set of seals 46. The seals 44, 46 thus substantially prevent fluid from entering the side pocket mandrel 12 via the second port 20.

The second valve assembly 26 is retained in the side pocket bore 16 by means of a latch assembly 47, and when the latch assembly 47 is released, is removable from the side pocket bore 16.

The side pocket mandrel 12 further comprises a check valve 48 which is moveable between a closed position in which it blocks flow of fluid between the side pocket bore 16 and the first port 18 when the pressure in the side pocket bore 16 exceeds the pressure at the inlet of the first port 18 and an open position in which it allows flow of fluid from the first port 18 into the side pocket bore 16. The check valve 48 engages with the second valve assembly 26 and is held in the open position by the second valve assembly 26, when the second valve assembly 26 is in the side pocket bore 16, and moves to the closed position when the second valve assembly 24 is removed from the side pocket bore 16.

Figure 2:
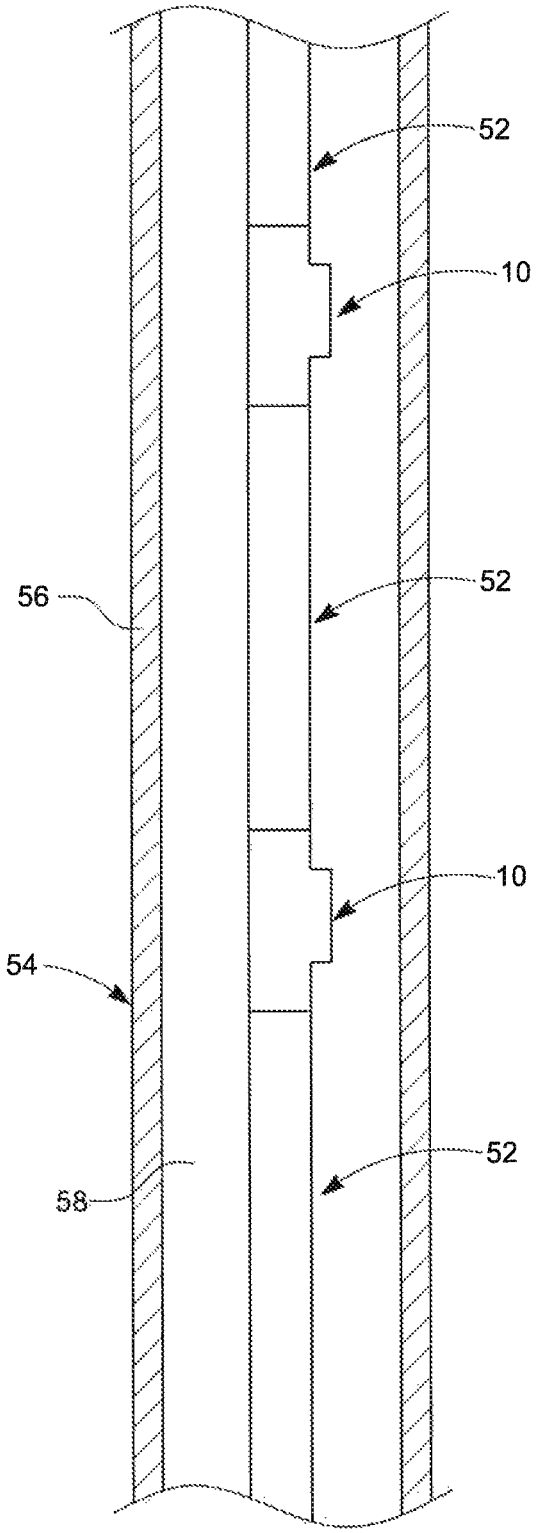
FIG. 2 is a schematic view of a longitudinal cross-section through a portion of a wellbore with the valve system illustrated in FIG. 1 inserted into the production tubing.

The ends of the side pocket mandrel 12 are provided with end connectors, in this case screw threads 49, 50, by means of which the side pocket mandrel 12 may be installed in a production tubing string 52 as illustrated in FIG. 2.

In this embodiment the first valve assembly 24 is mounted on the exterior surface of the side pocket mandrel 12 adjacent the first port 18. This need not be the case, however, and the valve system may further comprise a sub which encloses a main bore and which is secured to the end connectors 50 at one end of the side pocket mandrel so that the main bore of the sub aligns with the main bore 14 of the side pocket mandrel 12, the first valve assembly 24 being mounted on the sub. In this case, a conduit would be run from the outlet 25*b* of the first valve assembly 24 to the first port 18 to provide a fluid tight connection between the two.

FIG. 2 is a schematic illustration of a longitudinal cross-section through a portion of a wellbore 54 for hydrocarbon production. The wellbore 54 extends to a subterranean hydrocarbon containing formation and is lined with a well casing 56. A production tubing 52 extends down the wellbore, there being an annular space (the annulus 58) between the wellbore casing 56 and the production tubing 52. Valve systems 10 as described above are mounted in the production tubing 52 so that fluid passing along the production tubing 52 will pass along the main bore 14 of the side pocket mandrel 12 before entering the next length of production tubing 52, and fluid may be injected into the fluid flowing along the production tubing 52 via the side pocket bore 16.

A supply of pressurised gas, such as a gas compressor, may be located at surface and be connected with the annulus 58 to provide pressurised gas to the annulus 58. This pressurised gas will enter the inlet 25*a* of the first valve assembly 24, and, depending on the position of the choke 30 may pass into the first port 18 of the side pocket mandrel 12 via the outlet 25*b*. When the second valve assembly 26 is latched in place in the side pocket bore 16 the check valve 48 is open and, if the pressure of the pressurised gas exceeds the pressure in the main bore 14 of the side pocket mandrel 12, the gas can flow from the first port 18 past the check valve 43 in the second valve assembly 26 into the main bore 14 of the side pocket mandrel 12, where it may mix with the fluids flowing along the production tubing 52 (the production fluid) to provide the desired gas lift.

As mentioned above, the electronic controller 34 is configured to control the choke actuator 32 based on the signal received from one or more of the sensors in the sensor system 40 (and also, where provided, choke position signals from the position sensor and/or gas flow rate signals from the generator). As such, the electronic controller 34 can control the rate of injection of pressurised gas into the production fluid based on the temperature/pressure of the production fluid and/or on the temperature/pressure of the pressurised gas, and possibly also using feedback relating to the choke position and gas flow rate. This precise control of the gas injection may be used to optimise the gas lift process.

The signals from the sensor system 40 (and also, where provided, choke position signals from the position sensor and/or gas flow rate signals from the generator) may also be transmitted to a topside control centre via the date transmission cable 38 and signal interface 36, in order for the gas lift process to be monitored at the topside control centre.

The electronic controller 34 may be programmable and/or receive control signals from a topside control centre via the data transmission cable 38 and signal interface 36 (or wirelessly if so configured), and control signals may be transmitted to the topside control centre to the electronic controller 34 to change the way the electronic controller 34 adjusts the choke position in relation to the signals it receives from the sensor system 40 while the system is in operation, in order to further optimise the gas lift process.

Figure 3:
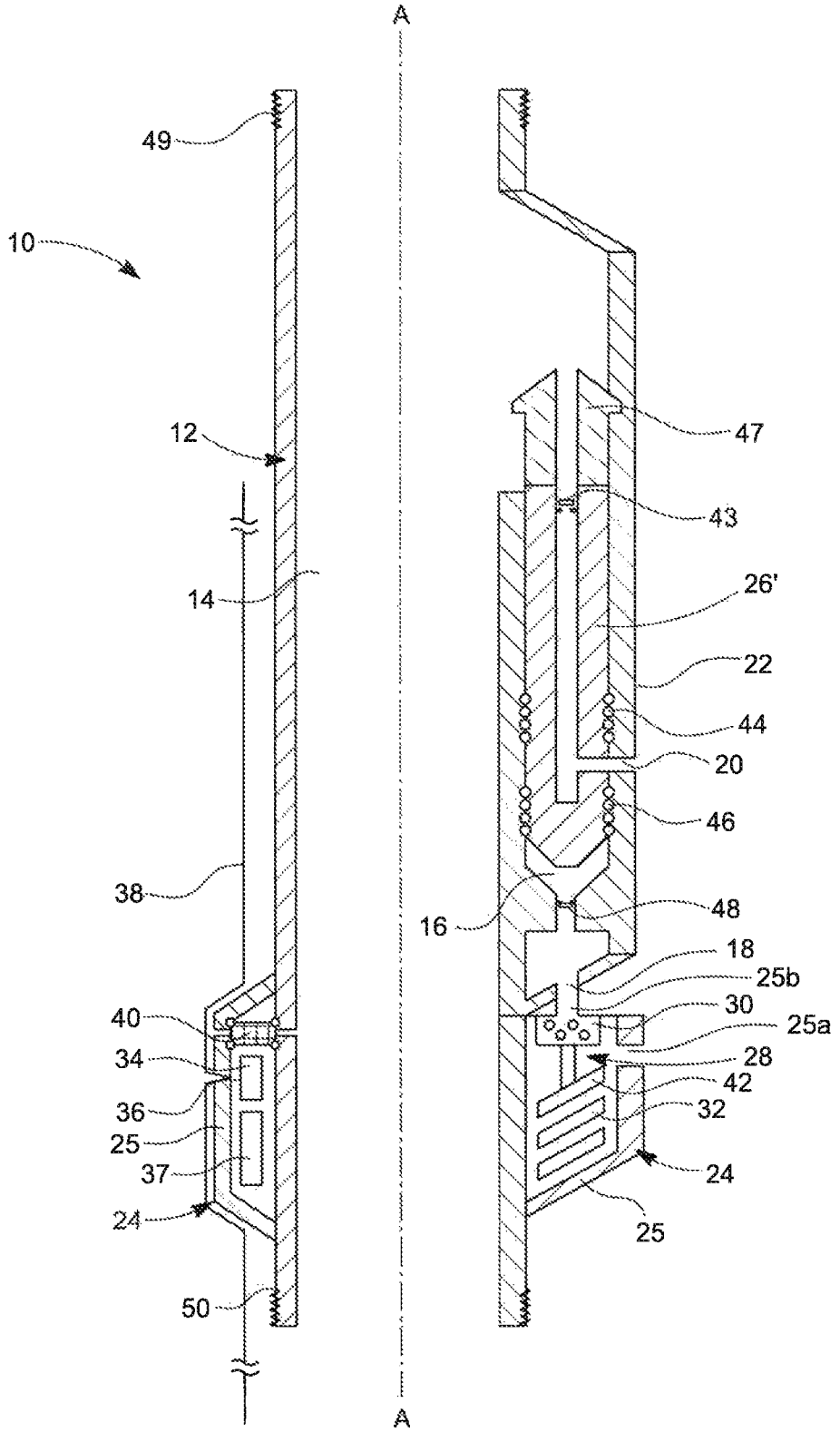
FIG. 3 is a schematic view of a longitudinal cross-section through an alternative embodiment of valve system according to the disclosed technology with the second valve assembly removed and replaced by a pressure operated valve in place in the side pocket bore and flow of fluid into the main bore via the second port and conventionally governed by the pressure operated valve

Advantageously, the latch assembly 47 and second valve assembly 24 are configured so that the release of the latch assembly 47 and removal of the second valve assembly 24 can be carried out using a wireline retrieval operation, with the second valve assembly 24 being pulled up through the production tubing 52. As such, if, during the gas lift process, there is an electrical fault in the first valve assembly 24, the choke 30 fails closed (i.e. blocks the flow of gas into the first port 18), and stops flow of gas into the side pocket mandrel 12, the second valve assembly 26 can be retrieved via a wireline. The removal of the second valve assembly 26 causes the check valve 48 to close to prevent flow of fluid through the first port 18 from the main bore 14. A conventional pressure operated gas lift valve may then be run down the production tubing 52 on a wireline and landed in the side pocket bore 16, to control flow of gas into the main bore 14 via the second port 20. The conventional gas lift valve is shorter in length to the retrieved second valve assembly 26 and thus when installed in the side pocket bore 16 does not engage and hold open the check valve 48. This is illustrated in FIG. 3. The valve system is therefore configured such that the gas lift process can be resumed without pulling the production tubing 52, albeit without the precise electronic control of the gas delivery provided by the first valve assembly.

Figure 4:
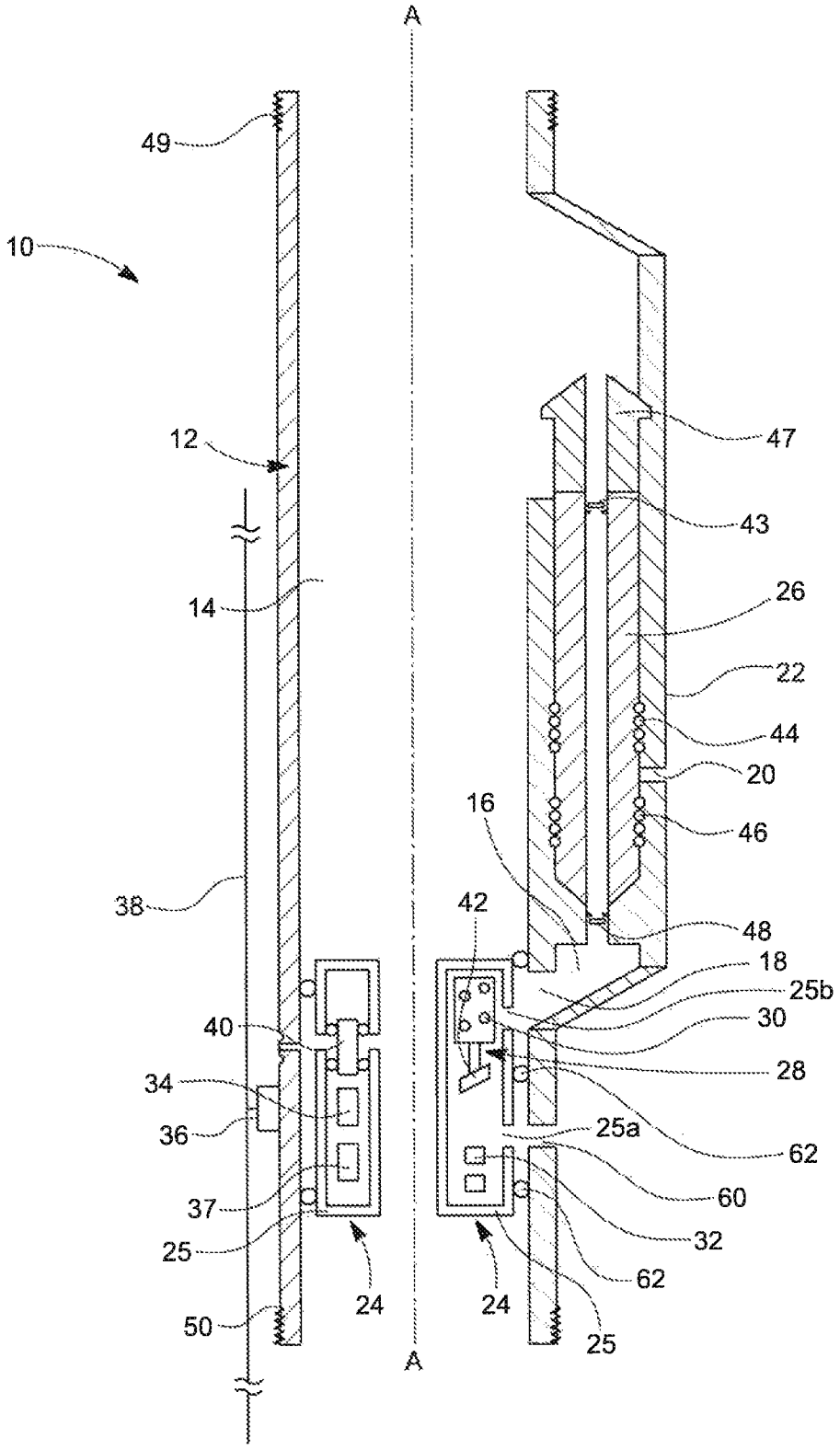
FIG. 4 is a schematic view of a longitudinal cross-section through a valve system according to the disclosed technology with the second valve assembly in place in the side pocket bore and flow of fluid into the main bore being controlled by the first valve assembly, but in this case the first valve system is enclosed in a sub that can be set in the tubing and interface and communicate with the data transmission cable via an inductive coupler or wet mate connector

An alternative embodiment of valve system is illustrated in FIG. 4. In this embodiment, the first valve assembly 24 is located in the main bore 14 of the side pocket mandrel 12, so that, in the event of its failure, it can be retrieved, and replaced by a wireline operation without pulling the production tubing 52. In this case, the first port 18 extends from the main bore 14 to the side pocket bore 16, and the side pocket mandrel is provided with a third port 60 which extends through the side pocket mandrel 12 from the exterior surface 22 thereof to the main bore 14. The first valve assembly 24 is configured to control flow of fluid from the exterior of the side pocket mandrel to the first port via the third port. This is achieved by arranging the first valve assembly 24 such that its inlet port 25*a* is in fluid communication with the third port 60, whilst its outlet port 25*b* connects the interior of the housing 25 to the first port 18. To ensure that substantially all the fluid passing through the third port 60 from the exterior of the side pocket mandrel 12 enters the housing 25 via the inlet port 25*a*, and all the fluid passing from the interior of the housing 25 and through the outlet 25*b* enters the first port 18, seals 62 are provided between the interior surface of the side pocket mandrel 12 and the housing 25 of the first valve assembly 24.

In this embodiment, if the first valve assembly 24 fails, it can be retrieved using a wireline operation, and either replaced with a new valve assembly, or with a sleeve which blocks the first and third ports 18, 60. In the latter case, the second valve assembly 26 would also be replaced with a conventional gas lift valve, in order to resume gas lift operations, with the gas entering the main bore 14 via the second port 20.

The invention is not limited by the embodiments described above; reference should be had to the appended claims.

The invention claimed is:

1. A valve system for use in a wellbore, the valve system comprising:

a side pocket mandrel having a main bore for alignment with tubing in the wellbore;

a laterally offset side pocket bore which is enclosed by a side pocket wall;

first and second ports which each extend through the side pocket wall into the side pocket bore;

a first valve assembly which is operable to control flow of fluid from the exterior of the side pocket bore into the side pocket bore via the first port; and a second valve assembly which is located in the side pocket bore to close the second port and which is operable to control flow of fluid from the side pocket bore to the main bore of the side pocket mandrel.

2. The valve system according to claim 1 wherein the first valve assembly is mounted outside the side pocket bore.

3. The valve system according to claim 1 wherein the first port extends through the side pocket wall from an exterior surface of the side pocket mandrel.

4. The valve system according to claim 3 wherein the first valve assembly is mounted on the exterior surface of the side pocket mandrel.

5. The valve system according to claim 1 wherein the first port extends from the main bore to the side pocket bore.

6. The valve system according to claim 5 wherein the side pocket mandrel is provided with a third port which extends through the side pocket mandrel from an exterior surface thereof to the main bore.

7. The valve system according to claim 6 wherein the first valve assembly is mounted in the main bore of the side pocket mandrel and configured to control flow of fluid from the exterior of the side pocket mandrel through the third port and to the first port.

8. The valve system according to claim 1 wherein the first valve assembly comprises a remotely controllable choke assembly which is operable to control the rate of flow of fluid from the exterior of the side pocket mandrel to the first port.

9. The valve system according to claim 8 wherein the choke assembly comprises a choke and an electrically or hydraulically operated choke actuator.

10. The valve system according to claim 8 wherein the first valve assembly comprises an electronic controller which is connected to and configured to control the operation of the choke assembly.

11. The valve system according to claim 10 wherein the electronic controller has a signal interface and is configured to transmit data signals via the signal interface.

12. The valve system according to claim 11 wherein the electronic controller is also configured to receive control and/or data signals via the signal interface.

13. The valve system according to claim 1 wherein the first valve assembly comprises a generator which is configured to convert energy derived from flow of fluid from the exterior of the side pocket mandrel to the first port and/or temperature differential energy between the exterior of the side pocket mandrel and the main bore into electrical energy.

14. The valve system according to claim 1 wherein the first valve assembly comprises a sensor system which is configured to measure one or more of the following: the pressure at the exterior of the side pocket mandrel, the temperature at the exterior of the side pocket mandrel, the pressure in the main bore of the side pocket mandrel, or the temperature in the main bore of the side pocket mandrel.

15. The valve system according to claim 1 wherein the second valve assembly comprises a check valve which moves from a closed position in which the check valve prevents flow of fluid between the first port and the main bore of the side pocket mandrel, to an open position, in which the check valve permits flow of fluid from the first port into the main bore of the side pocket mandrel, when the pressure at the first port exceeds the pressure in the main bore by a pre-determined amount.

16. The valve system according to claim 1 wherein the second valve assembly is removable from the side pocket bore, and the side pocket mandrel further comprises a check valve which is moveable between a closed position in which the check valve blocks flow of fluid between the first port and the side pocket bore and an open position in which the check valve allows flow of fluid between the first port and the side pocket bore, and which is configured be retained in the open position by the second valve assembly when the second valve assembly is in the side pocket bore, and to move to the closed position when the second valve assembly is removed from the side pocket bore.

* * * * *